US006009791A

United States Patent [19]

Medlin

[11] Patent Number: 6,009,791

[45] Date of Patent: Jan. 4, 2000

[54] ARMORED VEHICLE WITH A RETRACTABLE WEAPON PLATFORM SYSTEM

[76] Inventor: Richard C. Medlin, 3030 S. Chadbourne, San Angelo, Tex. 76903

[21] Appl. No.: 09/092,481

[22] Filed: Jun. 5, 1998

[51] Int. Cl.[7] ..... F41A 23/60

[52] U.S. Cl. ..... 89/38; 89/40.03; 89/37.07; 89/37.13; 89/136; 89/41.05

[58] Field of Search ..... 89/38, 39, 40.03, 89/37.03, 37.07, 37.13, 37.21, 136, 41.05

[56] References Cited

U.S. PATENT DOCUMENTS

| | | | |
|---|---|---|---|
| 38,118 | 4/1863 | Miller | 89/38 |
| 382,182 | 5/1888 | Nordenfelt | 89/39 |
| 678,064 | 7/1901 | Theis . | |
| 1,271,513 | 7/1918 | Lamar | 89/37.21 |
| 1,758,296 | 5/1930 | Schaumann . | |
| 1,928,306 | 9/1933 | Brennan | 89/40.03 |
| 2,024,773 | 12/1935 | Lohrman | 296/48 |
| 2,226,833 | 12/1940 | Rider | 296/84 |
| 2,399,184 | 4/1946 | Heckert | 154/52.5 |
| 2,425,498 | 8/1947 | Watter | 89/37.21 |
| 2,562,951 | 8/1951 | Rose et al. | 154/52.5 |
| 2,697,054 | 12/1954 | Dietz et al. | 154/52.5 |
| 2,743,035 | 4/1956 | Fogarty | 220/88 |
| 3,000,772 | 9/1961 | Lunn | 154/52.5 |
| 3,009,845 | 11/1961 | Wiser | 154/2.7 |
| 3,045,293 | 7/1962 | Potchen | 20/4 |
| 3,414,445 | 12/1968 | Orcutt | 156/106 |
| 3,424,642 | 1/1969 | Orcutt | 161/45 |
| 3,444,033 | 5/1969 | King | 161/38 |
| 3,453,161 | 7/1969 | Golightly | 156/102 |
| 3,455,409 | 7/1969 | Clark | 180/82 |
| 3,504,644 | 4/1970 | Schibisch | 109/49.5 |
| 3,509,833 | 5/1970 | Cook | 109/82 |
| 3,522,142 | 7/1970 | Wismer et al. | 161/190 |
| 3,581,621 | 6/1971 | Bauer | 89/36 |
| 3,791,914 | 2/1974 | Ammons et al. | 161/190 |
| 3,832,266 | 8/1974 | Archibald | 161/93 |
| 3,855,898 | 12/1974 | McDonald | 89/36.08 |
| 3,889,434 | 6/1975 | Shelver | 52/172 |
| 3,924,038 | 12/1975 | McArdle et al. | 428/49 |
| 3,930,452 | 1/1976 | Van Laethem et al. | 109/80 |
| 3,958,276 | 5/1976 | Clausen | 2/2.5 |
| 4,027,443 | 6/1977 | Briggs | 52/202 |
| 4,029,838 | 6/1977 | Chamis et al. | 428/301 |
| 4,057,359 | 11/1977 | Grooman | 415/9 |
| 4,061,815 | 12/1977 | Poole, Jr. | 428/215 |
| 4,075,386 | 2/1978 | Wildorf | 428/216 |
| 4,079,464 | 3/1978 | Roggin | 2/2.5 |
| 4,081,581 | 3/1978 | Littel, Jr. | 428/138 |
| 4,090,005 | 5/1978 | Morgan | 428/76 |
| 4,115,616 | 9/1978 | Heitz et al. | 428/310 |
| 4,130,684 | 12/1978 | Littell, Jr. et al. | 428/212 |

(List continued on next page.)

FOREIGN PATENT DOCUMENTS

| | | | |
|---|---|---|---|
| 1432466 | 2/1966 | France . | |
| 2205826 | 8/1973 | Germany | 89/38 |
| 2546291 | 4/1976 | Germany | 89/38 |
| 40 06 710 C1 | 6/1991 | Germany . | |
| 40 06 709 A1 | 9/1991 | Germany . | |
| 40 06 711 A1 | 9/1991 | Germany . | |

OTHER PUBLICATIONS

DuPont, KEVLAR® Aramid, *Lightweight Protective armor of KEVLAR® aramid*, brochure. 89/36.02

*Primary Examiner*—Stephen M. Johnson
*Attorney, Agent, or Firm*—Miller, Sisson Chapman & Nash, P.C.

[57] ABSTRACT

An armored vehicle having a stable, fast, relatively inexpensive retrofittable gun or weapon system including a retractable mounting platform which, in a lowered position, fits a weapon within the interior of the vehicle and, in a raised position, the gun or weapon above the roof of the vehicle, including a retractable platform and a remotely operated pan/tilt unit to control the position of a weapon into axes as the weapon is in a raised position above the roof of the car, which system includes a remote viewing system, a remote pan/tilt unit and a remote weapon activation system allowing the vehicle occupant to control the operation of the gun or weapon from within the vehicle while remotely aiming it.

9 Claims, 13 Drawing Sheets

U.S. PATENT DOCUMENTS

| | | | |
|---|---|---|---|
| 4,179,979 | 12/1979 | Cook et al. | 89/36.02 |
| 4,198,468 | 4/1980 | Molari | 428/412 |
| 4,198,707 | 4/1980 | Haupt et al. | 2/2.5 |
| 4,204,026 | 5/1980 | Le Grand et al. | 428/409 |
| 4,232,069 | 11/1980 | Windecker | 428/47 |
| 4,241,457 | 12/1980 | Klein et al. | 2/2.5 |
| 4,243,719 | 1/1981 | Holmes | 428/411 |
| 4,312,903 | 1/1982 | Molari, Jr. | 428/34 |
| 4,316,404 | 2/1982 | Medlin | 89/36.08 |
| 4,328,277 | 5/1982 | Molari, Jr. | 428/215 |
| 4,352,316 | 10/1982 | Medlin | 89/36 A |
| 4,595,624 | 6/1986 | Greathead | 428/213 |
| 4,648,136 | 3/1987 | Higuchi | 2/2.5 |
| 4,667,565 | 5/1987 | Anderson | 89/38 |
| 4,738,893 | 4/1988 | Grillo | 428/252 |
| 4,739,690 | 4/1988 | Moskowitz | 89/36.02 |
| 4,774,143 | 9/1988 | Gondela et al. | 428/442 |
| 4,861,666 | 8/1989 | LeGrand et al. | 428/412 |
| 4,911,061 | 3/1990 | Pivitt et al. | 89/36.02 |

ARMORED VEHICLE WITH A RETRACTABLE WEAPON PLATFORM SYSTEM

FIELD OF THE INVENTION

Armored vehicles, more specifically an armored vehicle with a retractable weapon platform system.

BACKGROUND OF THE INVENTION

Armored vehicles find use often in countries with political unrest for protecting their occupants. U.S. Pat. Nos. 4,333,282 and 4,352,316, the specifications and drawings of which are incorporated herein by reference, sets forth in more detail the advantages and features of armored vehicles and, in particular, armored vehicles constructed from commercial vehicles, such as the Chevrolet Suburban or the Toyota Land Cruiser, which vehicles are retrofitted with armor.

Occasions may sometimes arise when armor alone is insufficient to protect the occupants of the vehicle. More specifically, it is sometimes desired and necessary for the armored vehicle to include a weapon. Herein Applicant discloses one such armored vehicle including a retractable weapon platform system.

OBJECTS OF THE INVENTION

It is an object of the present invention to provide for an armored vehicle having a gun or weapon system including a retractable mounting platform which, in a lowered position, fits a gun or weapon within the interior of the vehicle and, in a raised position, places the gun or weapon above the roof of the vehicle.

It is another object of the present invention to provide for a stable, fast, relatively inexpensive retrofittable gun or weapon system including a retractable platform and a remotely operated pan/tilt unit to control the position of a weapon in two axes, as the weapon is in a raised position above the roof of the car.

It is a further object of the present invention to provide a gun or weapon system retractable between a raised position placing the gun or weapon above the roof and a retracted or lowered position placing the gun or weapon within the interior of the commercial vehicle, which system includes a remote viewing system, a remote pan/tilt unit and a remote weapon activation system allowing the vehicle occupant to control the operation of the gun or weapon from within the vehicle while remotely aiming it.

SUMMARY OF THE INVENTION

In a commercial vehicle retrofitted with armor, the commercial vehicle having a roof with an opening therein and an interior, the interior including a floor, a weapon system, the weapon system comprising a frame rigidly mounted to the floor of the commercial vehicle and the interior thereof, the frame with fixed end rotatable legs; a platform, said platform moving and engaging the frame at the legs thereof for moving the frame between a lowered and raised position; a first motor, the first motor including a shaft having at least one pulley mounted thereon; a belt for engaging the pulley of the first motor and at least one rotatable leg wherein energizing the first motor causes the at least one leg to rotate and move the platform between the lowered and the raised positions; a remote controlled pan/tilt unit, mounted to an upper surface of the platform and including a weapon mount mounted to the pan/tilt unit, the unit capable of moving the weapon mount into axes and such movement capable of being controlled from the interior of the vehicle; a remote viewing means, said remote viewing means including at least one video camera for mounting to either of the weapon mount or the pan/tilt unit and a monitor for mounting to the interior of the vehicle; means for removably covering the opening in the roof of said commercial vehicle, said removable covering means including a second motor for operating said removable covering means; control means for operating said first and said second motor from the interior of the commercial vehicle; a weapon for mounting to the weapon mount of said pan/tilt unit and remote firing means for remotely firing the weapon when the platform is in a raised position.

DETAILED DESCRIPTION OF THE PREFERRED EMBODIMENT

I. THE FRAME AND PLATFORM

Figure 1:
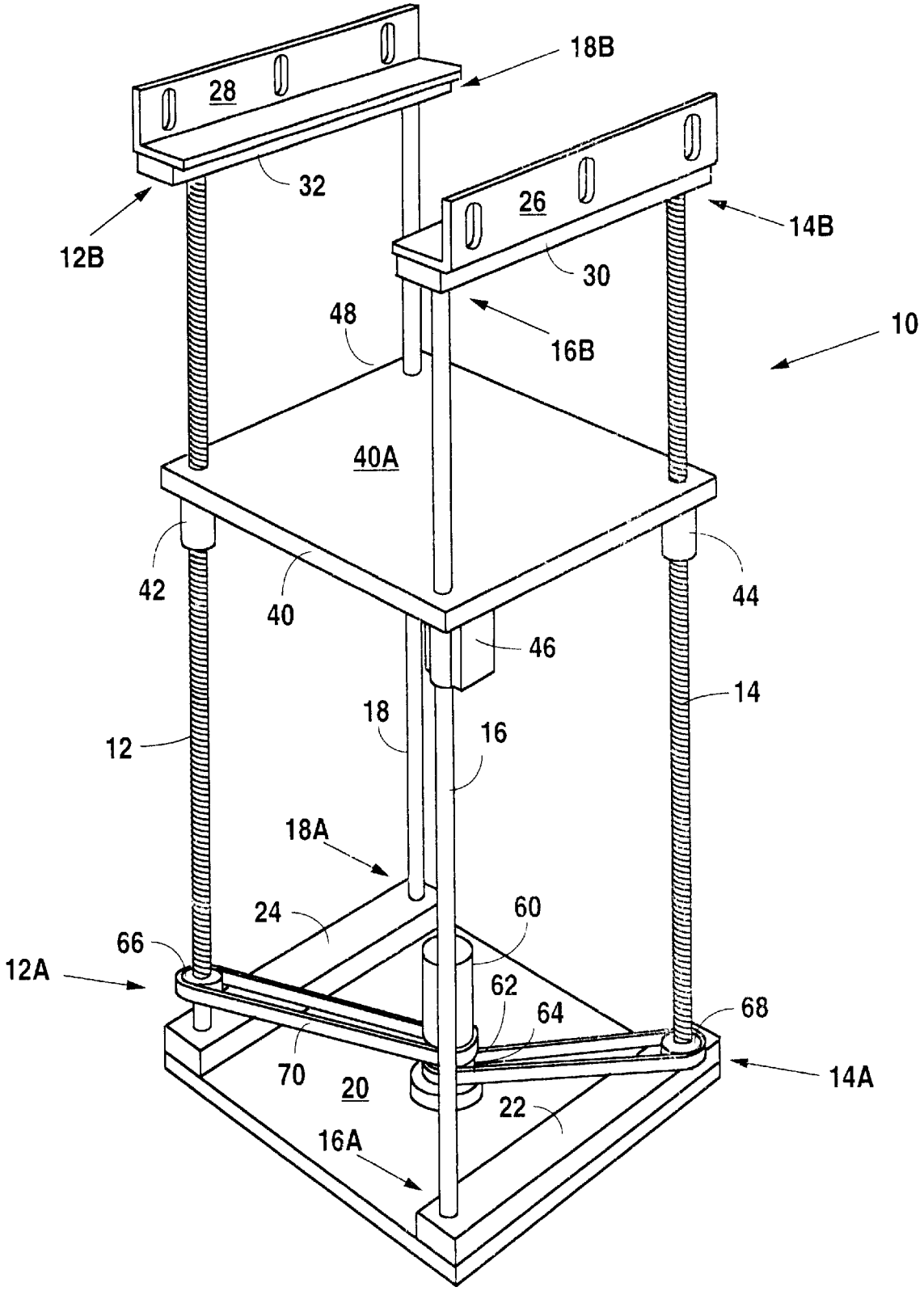
FIG. 1 is a perspective view of the frame and platform of Applicants' present invention with the platform between the lowered and the raised positions.
Figure 2:
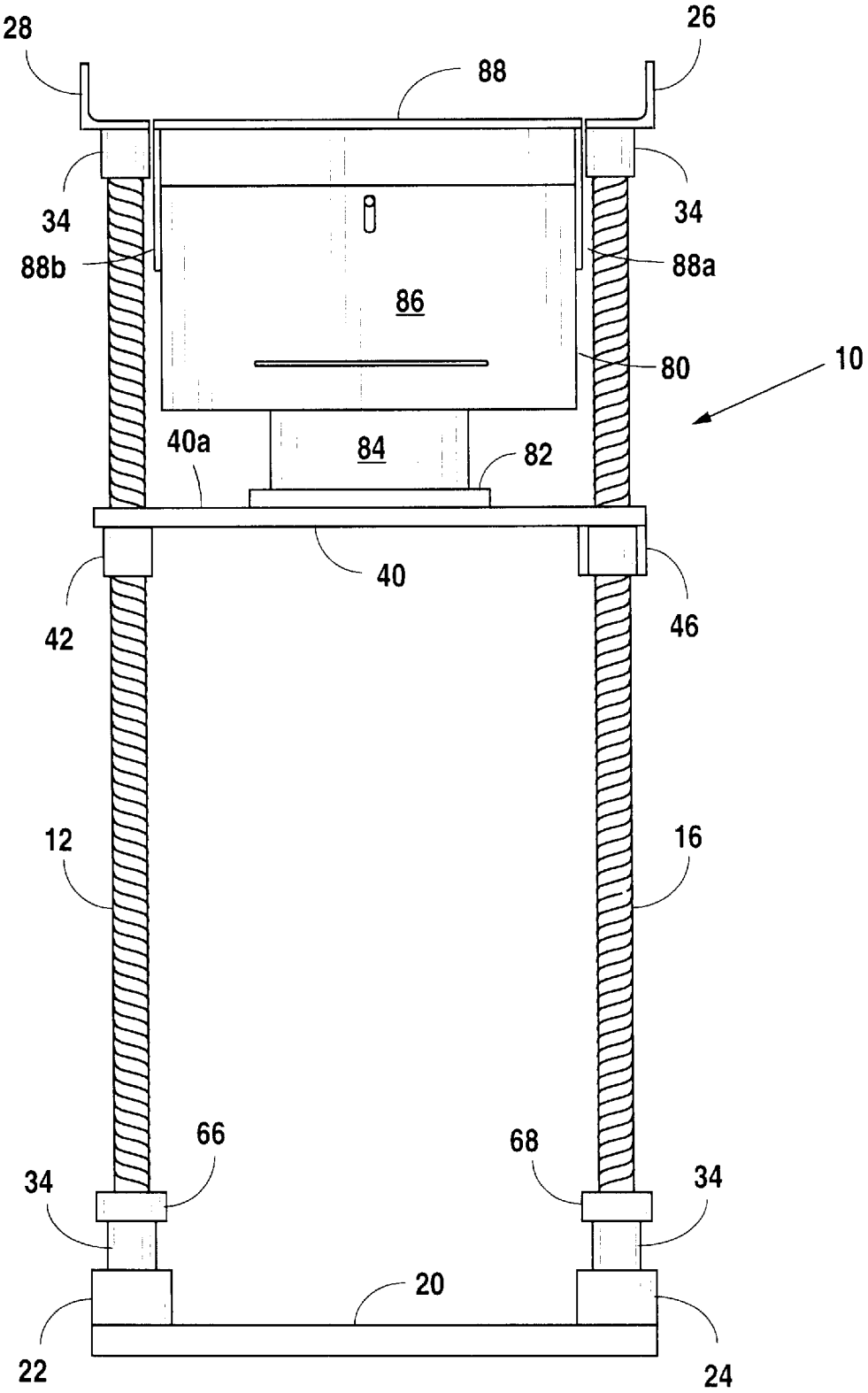
FIG. 2 is a side elevational view of the frame and platform of Applicants' present invention with the platform between the lowered and the raised positions.
Figures 3, 3B:
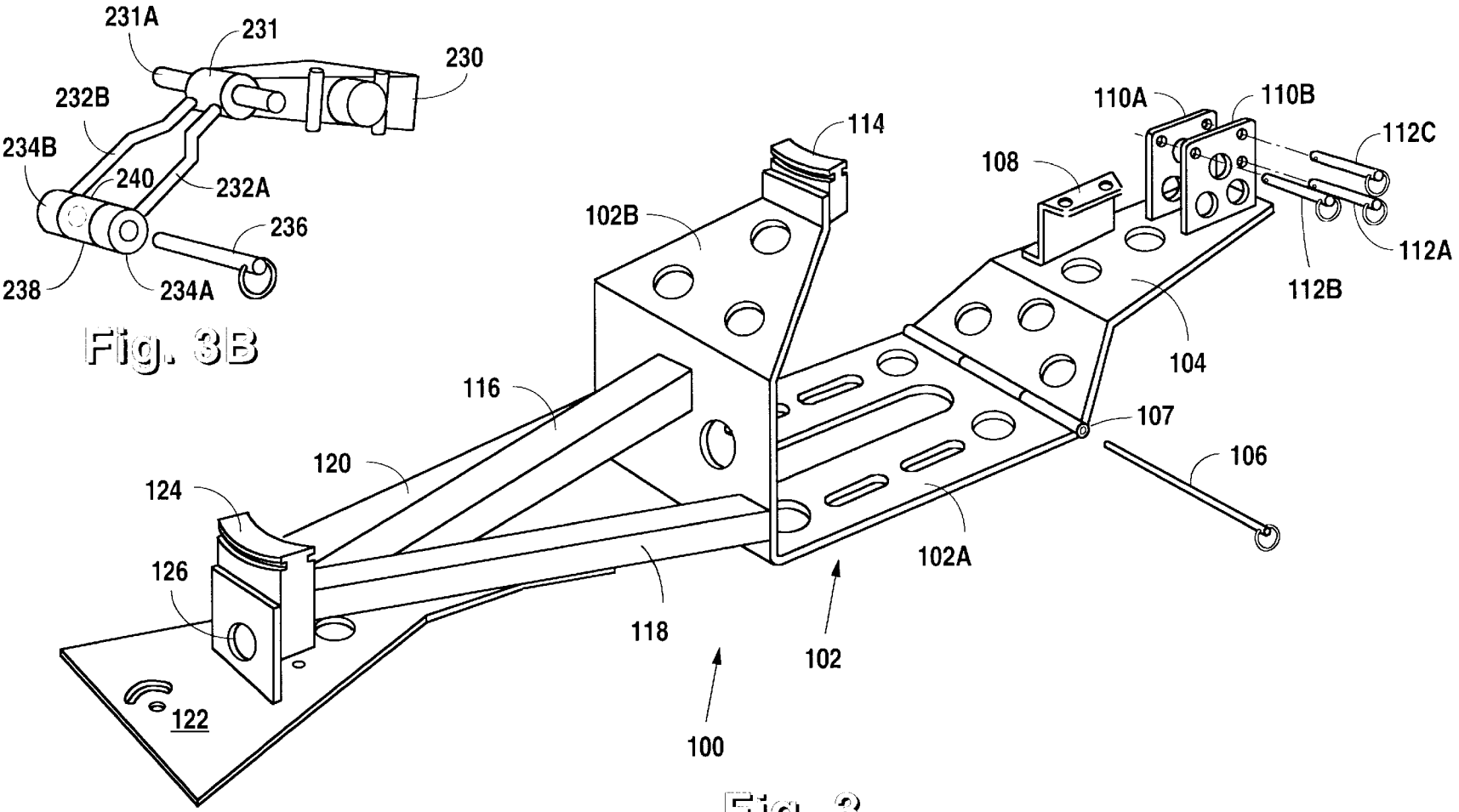
FIG. 3 is a perspective view of the gun mount assembly of Applicants' present invention.
FIG. 3B is a perspective view of the mechanism which activates the trigger of Applicants' present invention.
Figure 3A:
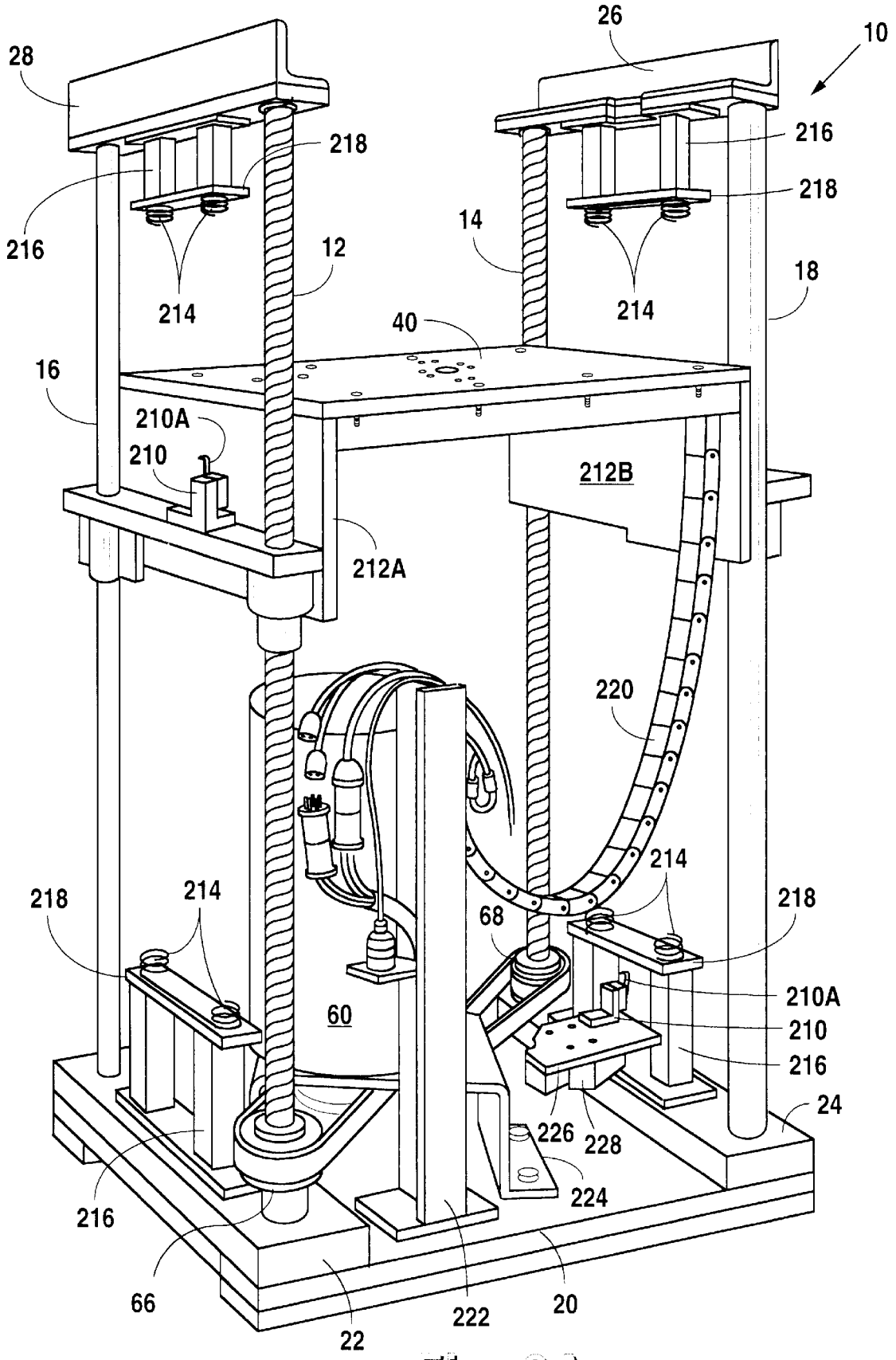
FIGS. 3A is a perspective view of the frame and platform of Applicants' present invention with the platform between the lowered and the raised positions, illustrating additional features thereof.

FIGS. 1, 2, and 3A illustrate means for providing a platform movable between a lowered and a raised position for moving a gun or weapon between a position within the interior of a commercial vehicle and above the roof of a commercial vehicle for protection of the occupants through remote aiming and firing of the weapon.

More specifically, FIG. 1 illustrates in perspective view a frame (10) for attachment to the interior of a commercial vehicle and including a first rotatable leg (12) having a first end (12*a*) and a second end (12*b*) and a second rotatable leg (14) having a first end (14*a*) and a second end (14*b*), the rotatable legs having threaded surfaces thereon The frame further includes a first rigid leg (16) having a first end (16*a*) and a second end (16*b*), and a second rigid leg (18) having a first end (18*a*) and a second end (18*b*), the rigid legs having smooth surfaces. It is seen that the legs are rectangularly set at the corners of a rectangular (typically plate aluminum) base plate (20). The base plate is mounted to the floor of the interior of the commercial vehicle. The base plate includes a pair of base plate leg mounting members (22) and (24).

The second ends of the four legs are attached, through the use of a pair of upper leg brackets (26) and (28), here L-shaped and including spacer blocks (30) and (32), to the interior of the vehicle. The upright portions of the upper leg brackets (26) and (28) include holes to attach them to appropriate mating members on the interior of the vehicle surface. The effect of the construction of the frame is to provide four strong legs mounted to the interior of the vehicle that will provide for a stable platform in the manner set forth in more detail below. Moreover, it is seen that the first and second ends of rotatable legs (12) and (14) engage spacer blocks (30) and (32) as well as leg mounting members (22) and (24) at bearings (34), such as those provided by San Angelo Bolt or McMaster-Carr as thrust bearing P/N6075K13. The effect of the use of the bearings is to allow the rotatable legs to rotate with respect to the spacer blocks and leg mounting members as set forth in more detail below.

It is seen that mounted to the four legs is a platform (40) having an upper surface (40*a*) thereon. Moreover, it is seen that the platform is typically rectangular and may be made out of ½ inch aluminum stock. The four corners of the rectangular platform are drilled out to allow the legs to pass therethrough; and, on the underside of the platform, there is attached a first threaded nut (42) and a second threaded nut (44) to accept the body of the first rotatable leg and the second rotatable leg, respectively, therethrough. These threaded nuts may be provided by McMaster-Carr as ACME thread P/N98940A120. It is seen that the first rotatable leg and the second rotatable leg are spaced along a diagonal of the frame as are the two rigid legs. Further, it is seen that the underside of the platform carries two linear blocks, here a first linear block (46) and a second linear block (48) to slidably receive the smooth surface of the two rigid legs (16) and (18). With reference to the platform and the frame, it can be appreciated that the rotation of the legs will cause platform (40) to move up or down.

With further reference to FIGS. 1 and 2, it is seen that mounted adjacent an upper surface of the base plate is an electric motor (60) such as a 12 volt DC electric motor provided by McMaster-Carr as Part No. 59835K74 (40A ½ h.p.). Typically, electric motor (60) has attached to it a drive shaft (not shown), having thereon a first drive pulley (62) and a second drive pulley (64). Moreover, it can be seen that at first end (12*a*) and second end (14*a*) of the first rotatable leg and the second rotatable leg is rigidly mounted a first driven pulley (66) and a second driven pulley (68), respectively. The first drive pulley and the first driven pulley are connected by a first belt (70) and the second drive pulley and the second driven pulley are connected by a second belt (72) such that, when motor (60) is energized, first rotatable leg (12) and second rotatable leg (14) rotate and move through interaction with first threaded nut (42) and second threaded nut (44) of platform (40) between a lower position nearer or adjacent base plate (20) to a raised position near or adjacent upper leg brackets (26) and (28).

II. THE PAN/TILT UNIT

With reference to FIG. 2, it is seen that upper surface (40*a*) of the platform includes attached thereto a pan/tilt unit (80). The pan/tilt unit includes a pan/tilt unit mounting plate (82) for mounting to the top surface of platform (40). Attached to the pan/tilt unit mounting plate is a pan/tilt unit mounting shaft (84) to which rotatably mounted is pan/tilt unit housing (86) for panning action. At the top of the pan/tilt unit housing is a tilt unit (88) for tilting. Thus, pan/tilt unit (80) provides for motion in two axes, a panning motion and a tilting motion. Further, it can be appreciated that anything, such as a weapon mount mounted to tilt unit (88) may be moved through two axes through remote operation of pan/tilt unit (80).

Pan/tilt units are available from a number of sources. One such source that may be utilized with Applicant's invention is the PT1250 Series pan/tilt units manufactured by Pelco™ of 300 West Pontiac Way, Clovis, Calif. 93612. The PT1250 Series pan/tilt unit has operations and installations described in the Installation/Operation Manual C370M-G (1996), which manual is incorporated herein by reference. The Model PT1250DC pan/tilt unit described therein is a suitable outdoor, heavy-duty pan/tilt unit having enclosed in the pan/tilt unit housing (86) a 115 v DC electric motor with gears and bearings and also includes cables and is available with desk top control for variable speed operation of the pan/tilt including a joystick for joystick operation of the pan/tilt unit (see FIG. 12 below). Tilt unit (88) may be modified by cutting a section out of the vertical arms (88*a*) and (88*b*) in order to reduce the effect of recoil on the interior gears of the pan/tilt unit. The internal gears of the pan/tilt unit may be modified to put stops on them so the gun cannot be lowered too far so as to accidentally hit the vehicle when fired.

FIG. 3A illustrates additional views of the frame and platform system with more features. In this embodiment, it is seen that limit switches (210) with limit switch arms (210*a*) are used to limit the upper and lower travel of platform (40). Further, it is seen that platform (40) is offset with respect to bearings by use of offset plates (212*a*) and (212*b*) in order to raise the level of the platform when it is in an uppermost position. The embodiment illustrated in FIG. 3A also shows the use of 4 sets of coil springs (214) (2 sets for cushioning the upper movement and 2 sets for cushioning the lower movement of platform (40)). The function of the coil springs (here seen to be set on coil spring support stands (216) is to intercept the movement of the platform before it reaches the upper and lower stops and to activate the limit switch such that there is no hard contact between the platform and the upper barriers and lower barriers (here plates (218)). With a hard stop, the threaded nuts (42) and (44) may be jammed and the motor may not be strong enough to begin the upper or lower movement of the platform, as the case may be. By using the coil springs as illustrated, when the platform stops as a result of limit switch arms (210*a*) intercepting stop plates (218), the platform will be spring loaded. This will also help "shock mount" in a suspended manner the platform (40) in the frame. Likewise, when the platform reaches its lower limit, the limit switch arms will intercept the stop plate before there is hard contact and the coil springs will take up the movement to spring load the platform when it is in its lowered position.

FIG. 3A also illustrates the use of a wire loom (220) such as that available from McMaster-Carr to run wires used to energize the motor and the wires to the Pelco™ unit and the remaining unit through to effect a clean structure. Further, it is seen that wire loom (220) (with wires therein) is draped over a wire loom support plate (222) such that when the platform moves up and down, the wire loom can lift cleanly off the top of the wire loom support plate and, when the platform moves to a lower position, can drape cleanly in the space beneath the platform.

Motor (60) is held in place through use of motor mount bracket (224) which is bolted to base plate (20). Motor relay mount bracket (226) is used to mount two 30-amp relays (228) for the motor (60).

III. THE GUN MOUNT ASSEMBLY AND GUN

FIG. 3 illustrates a gun mount assembly (100) for mounting a gun to the pan/tilt unit. The gun mount assembly includes a gun mount assembly mounting bracket (102) made of bent metal drilled for lightness and for mounting to the pan/tilt unit. The gun mount assembly mounting bracket includes a base portion (102*a*) and an upright portion (102*b*), the two portions perpendicular to one another, the base portion for attaching to the pan/tilt unit and the upright portion for locating the gun in the manner set forth in more detail below.

Gun mount assembly (100) includes a stock support portion (104) which is attached, through the use of a long pin (106) to the gun mount assembly mounting bracket (102) at a removed end thereof, wherein a portion of the stock support and the gun mount assembly mounting bracket together form a long pin tube (107) which, when long pin (106) is inserted therein, rotatably mounts stock support to the gun mount assembly mounting bracket.

Stock support (104) includes a solenoid bracket (108) to which, when a gun is mounted to the gun mount assembly, will hold the solenoid unit for activating the trigger of the gun (see also FIG. 3B). Also on the stock support are a pair of stock support plates (110*a*) and (110*b*) which are drilled for lightness and also drilled for acceptance therethrough of several (typically 3) stock support plate pins (112*a*), (112*b*), and (112*c*). These are typically ball-lock pins to ensure positive engagement. The stock of the weapon mounted to the gun mount assembly is inserted between the stock support plates and, with the stock appropriately drilled for receipt of the pins therethrough, will locate and maintain the stock on stock support (104) with the solenoid bracket locating a solenoid for activating the trigger of the weapon adjacent the trigger of the weapon.

Turning now to upright portion (102*b*) of gun mount assembly bracket (102), it is seen that at an upper end thereof is mounted a rear saddle (114) which has a concave upper surface to cradle a portion of the weapon attached to the gun mount assembly. Further, it is seen that projecting forward from upright portion (102*b*) is a trio of arms including middle arm (116), left arm (118), and right arm (120). At the removed end of the arms is located a camera mount bracket (122) for mounting a remote operated field-of-view video camera below the barrel of the weapon. The camera mount bracket may be attached to one or more of the arms in a rigid manner, such as by welding. At the removed end of the left and right arms is a front saddle (124) with a concave upper surface for placing and attaching the barrel of the weapon attached to gun mount assembly (100) thereto. Further, a coax stabilizer (126) may be provided and attached to the front saddle and the camera mount bracket to help stabilize a coaxial cable which is in turn attached to the camera that is mounted to camera mount bracket (122). The cables operating the camera mount may be seen through the middle arm.

Gun mount assembly (100) is attached with its longitudinal axis perpendicular to the axis on which tilt unit (88) of pan/tilt unit (80) runs. It is attached in a conventional manner using readily available fasteners.

The particular gun mount assembly illustrated is designed to mount an HK21E manufactured by Heckler & Kock and available from H&K USA of Sterling, Va. Before attempting to mount the weapon, the magazine should be removed and the chamber checked to make sure it is empty. The platform should be in an up or raised position. The HK21E attaches to the gun mount assembly using existing bipod attachment points on the gun. With the gun safety on, the trigger actuator is attached to the gun by first removing the retaining pin and trigger bumper from the actuator. Then the actuator rod is inserted through the gun's trigger guard and the trigger bumper washer and retaining pin is replaced. The stock support of the gun mount assembly is then attached to the stock of the gun using the stock support bracket pins.

FIG. 3B illustrates the mechanism which attaches to the trigger and trigger guard of the weapon and to solenoid bracket (108) to activate the trigger. A door lock actuator (230) is used, such as that manufactured by SPAL as a trigger actuator, available from Iowa Imports. This door actuator is a DC solenoid unit which includes an actuator arm which has at the end thereof a hard plastic disc-shaped actuator head (231). Through the center of actuator head (231), Applicant sets a 10/32 inch bolt (231*a*) to which are attached two stainless steel arms (232*a*) and (232*b*) so that the arms may pivot with respect to actuator head (231). Arms (232*a*) and (232*b*) go outside the trigger arm and at the removed end thereof have loops (234*a*) and (234*b*) to rotatably enclose a pin (236). Engaged rotatably with the pin is a roller (238) with groove (240) in the center thereof. With door lock actuator (230) mounted to solenoid bracket (108) arms (232*a*) and (232*b*) are located adjacent the sides of the trigger guard of the weapon and roller (238) is laid against the trigger such that the trigger rides in groove (240). The pin (236) is inserted. When actuator (230) is energized, the shaft of the door lock actuator retracts and roller (238) acts to depress the trigger and fire the weapon.

IV. THE ROOF OPENING SYSTEM

Figure 4:
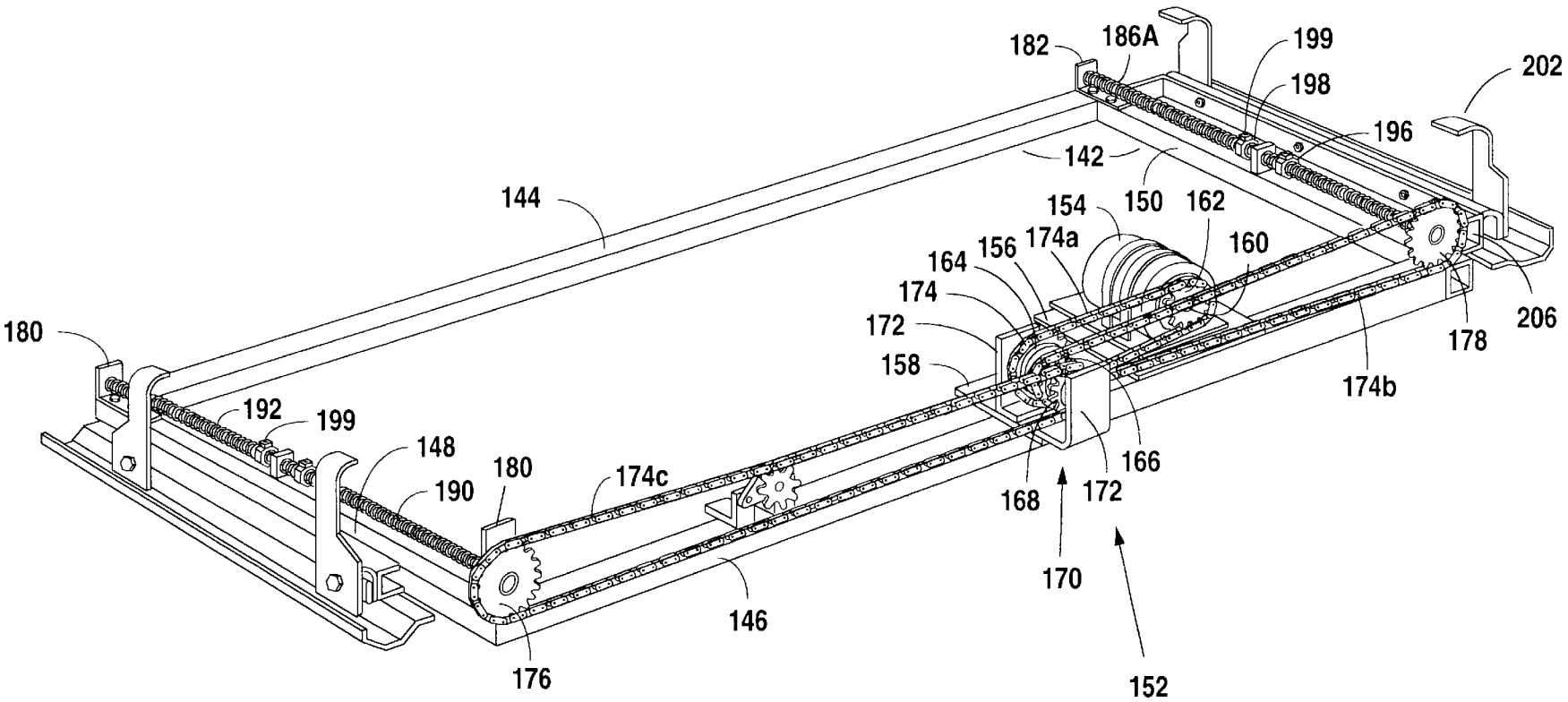
FIG. 4 is a perspective view of part of the roof operating system of Applicants' present invention.
Figure 4A:
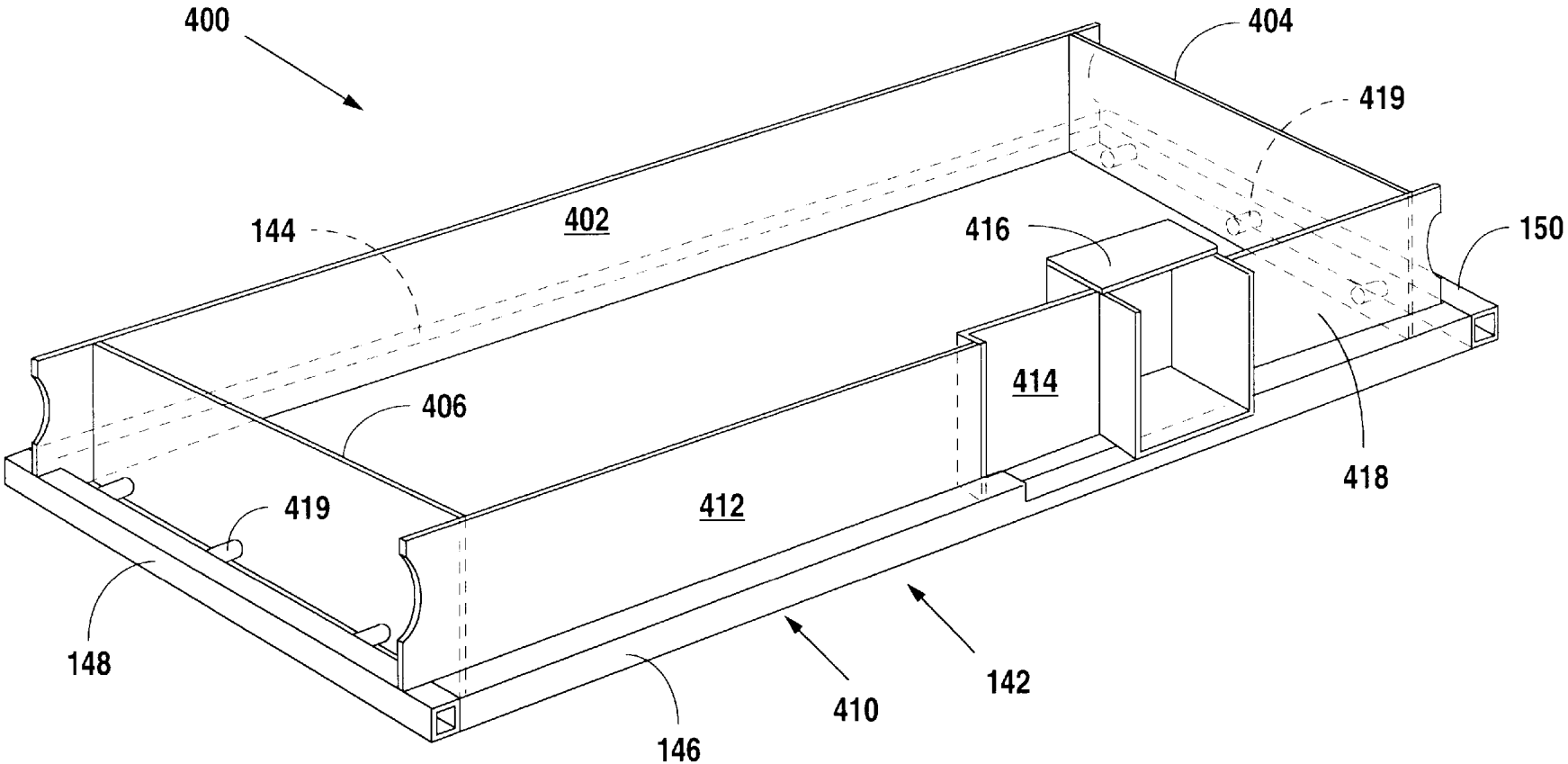
FIG. 4A is a perspective view of the armor skirting assembly of Applicants' present invention as used on the roof covering system.

FIGS. 4–11B are details of a roof opening system, and specifically FIG. 4A, it is seen that an armor skirting assembly (400) is attached to a frame (142) which, when completed, is attached adjacent the opening of the roof of the vehicle and which frame is shaped like the opening of the roof of the vehicle, that is, rectangular in shape. Armor skirt assembly (400) includes right panel (402), rear panel (404), front panel (406), and left side armor (410), which includes front left panel (412), mid left panel (414), motor housing subassembly (416), and left back panel (418). All of the panels are typically made of ⅛ inch ballistic steel mounted to the frame (142) by bolts at frame side members (144) and (146) and with spacer bolts (419) at front and rear frame members (148) and (150). The armor skirting assembly will provide bullet-proof protection to the roof cover assembly (140) as set forth in more detail with respect to FIG. 4 below. The armored commercial vehicle is equipped with a rectangular opening cut in the roof thereof to which, adjacent the opening, armor skirting assembly (400) on frame (142) is attached. It is this opening through which the gun mounted to the gun mount assembly and pan/tilt unit will issue in response to the appropriate commands from the operator seated in the interior of the vehicle.

However, in the preferred embodiment of Applicant's present invention, the roof opening of the commercial vehicle is provided with a roof cover drive assembly (140) as illustrated in FIGS. 4–9. The elements of the roof cover assembly attache to frame (142) and are protected, in part, by the armor skirting assembly (400). The purpose of the roof cover drive assembly is to provide drive to a removable cover, armor plated, which can be opened when the platform is ready to be raised and can be closed around the platform when the platform is in a raised position or completely closed when the platform is lowered and the weapon is inside the interior of the vehicle.

Turning now to FIG. 4, it is seen that Applicant's weapon system is provided with a roof cover drive assembly (140) which includes frame (142) for mounting the assembly adjacent the opening on the roof thereof. Frame (142) is seen to have two side members, right side member (144) and left side member (146). The two side members are joined by front cross member (148) and rear cross member (150) to provide a generally rectangular structure, the front and side members typically being made of 1 inch square section steel tubing 1/16 to 1/8 inch walls welded together. The frame provides appropriate structure on which to mount the remaining elements of roof cover drive assembly (140) in the manner set forth with reference to FIGS. 4–9 below.

Figure 5:
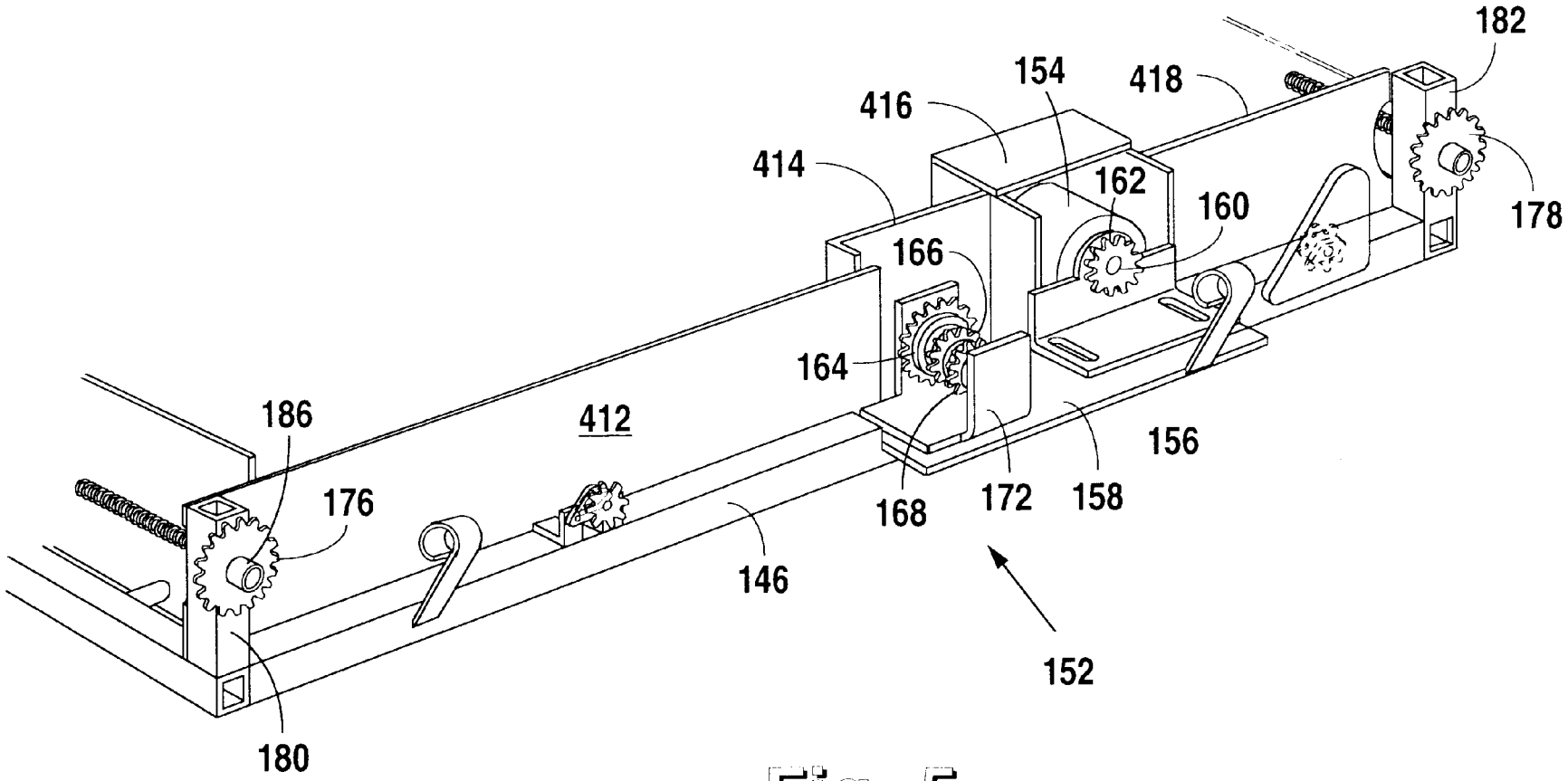
FIG. 5 is a perspective view of details of the chain drive assembly of Applicants' present invention.

With reference to FIGS. 4 and 5, elements of a chain drive assembly (152) can be appreciated. These elements include an electric motor (154) such as a DC 12V motor of 1/8 to 1/4 horsepower provided by McMaster-Carr. The chain drive assembly electric motor (154) is mounted on the motor mounting bracket (156) which is in turn mounted to a support plate (158) which is welded or otherwise fastened to the left side member (146) of frame (142). A drive shaft (160) on electric motor (154) includes at the removed end thereof a primary drive sprocket (162). The primary drive sprocket is aligned with an intermediate drive sprocket (164) which in turn is attached to and rotates with a front drive sprocket (166) and a rear drive sprocket (168). The intermediate drive, front drive, and rear drive sprockets together form an intermediate gear cluster (170) which is held between the upright arms of a support bracket (172) to support plate (158). Thus, when electric motor (154) is energized, it rotates drive shaft (160) with primary drive sprocket (162) thereon and a chain (174*a*) drives intermediate drive sprocket (164) which in turn causes front drive sprocket (166) and rear drive sprocket (168) to rotate. Such rotation will transfer rotary movement to a front-driven sprocket (176) and a rear-driven sprocket (178). The motion is transferred through a chain (174*c*) to front-driven sprocket (176) and a chain (174*b*) to a rear-driven sprocket (178). Further, it is seen that at the front and rear corners of frame (142) there is attached support shafts (180) and (182), respectively.

Figure 6:
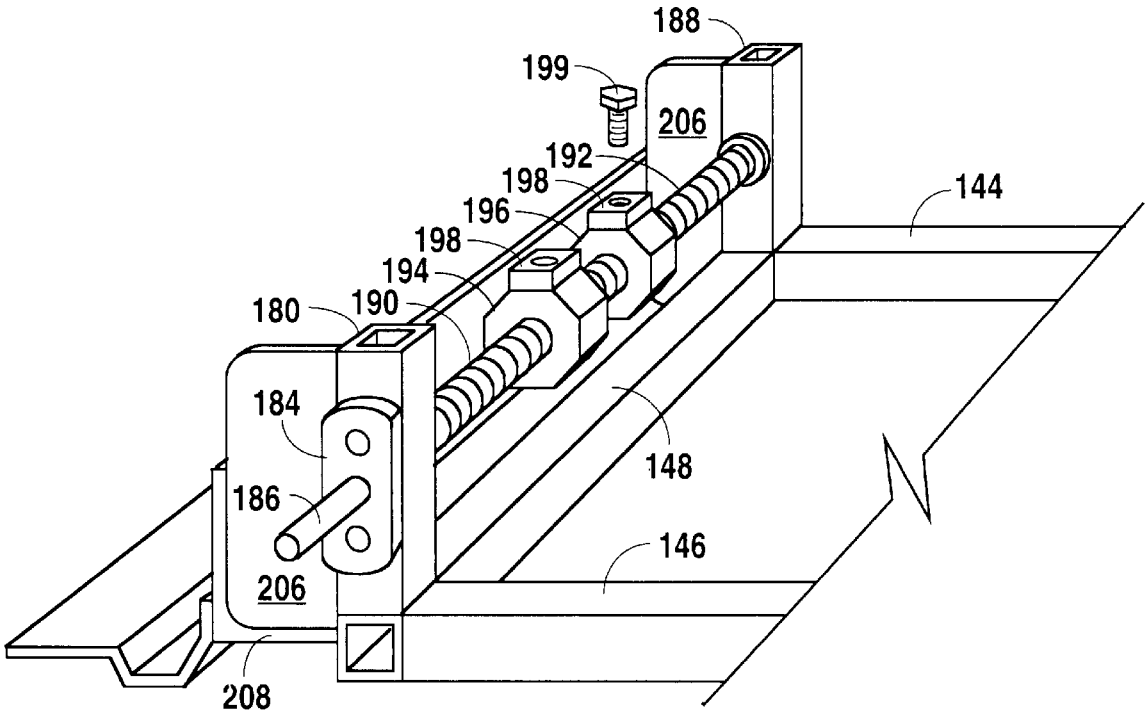
FIG. 6 is an additional view, in perspective, of the chain drive assembly of Applicants' present invention.
Figure 7:
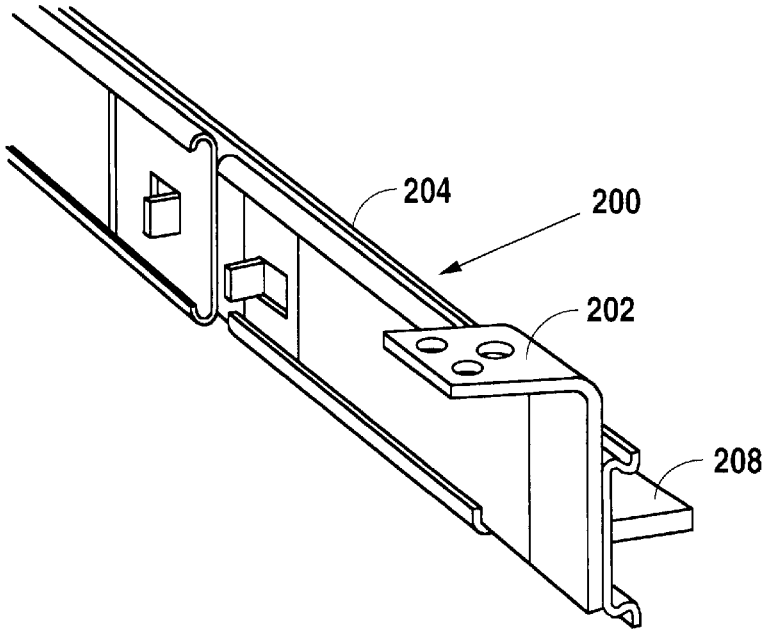
FIG. 7 is a perspective view of a slide mechanism used to support the outer skin of the roof half cover of the roof assembly of Applicants' present invention.
Figure 8:
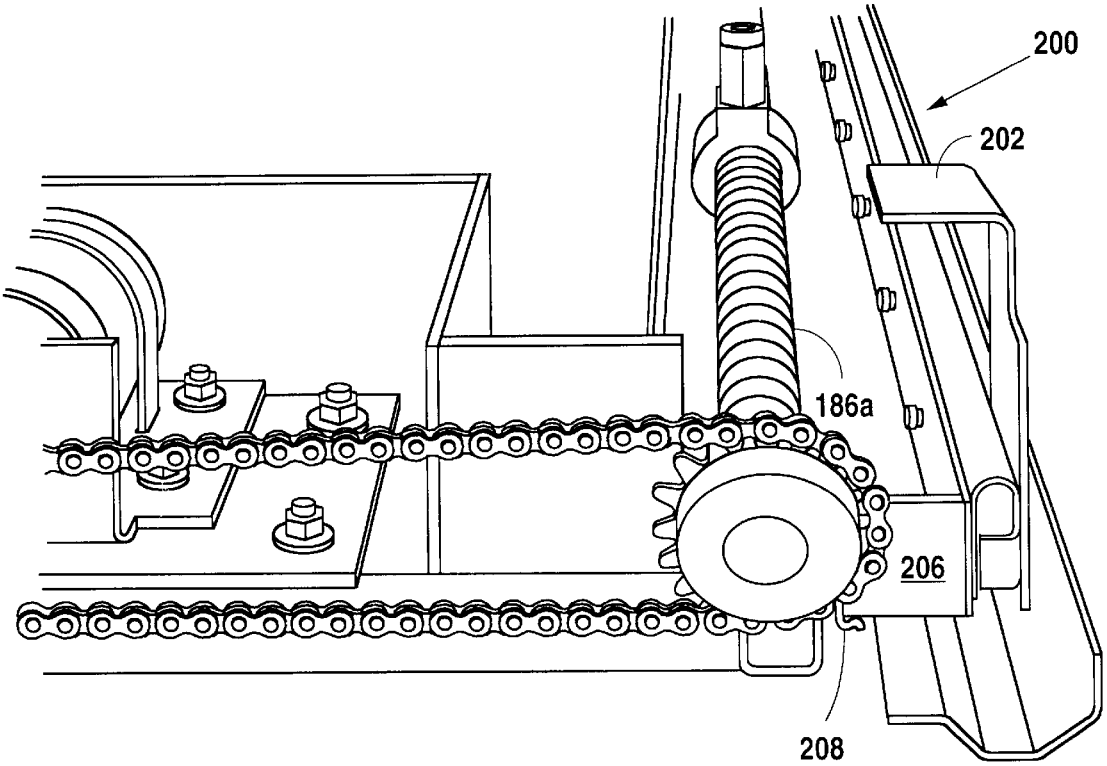
FIG. 8 is an illustration of the perspective view of the chain drive of Applicant's present invention.

Turning now to FIGS. 6–7 and with further reference to FIGS. 4 and 5, additional elements of Applicant s roof cover assembly (140) and chain drive assembly (152) may be appreciated. More specifically, FIG. 6 illustrates that attached to left front support shaft (180) is a shaft bushing (184) through which passes a front door half cover drive shaft (186) which extends above front cross member (148) to front right support shaft (180) where it rotatably articulates on another shaft bushing (not shown). Further, with reference to FIGS. 5 and 6, it may be seen that front door cover drive shaft (186) is comprised of threaded rod portions (190) and (192) which are reverse drives with respect to one another, segmented at about the center (longitudinally speaking) of drive shaft (186) in a manner set forth in more detail below. In other words, if threaded rod portion (192) is a left-hand thread, then threader rod portion (190) is a right-hand thread. The threaded rod used on door cover drive shafts (there is the front and a rear (186*a*) (see FIG. 4) with similar construction) is similar to the rotatable legs of the frame of the platform-raising mechanism and is sometimes called ACME thread rod and may be purchased through McMaster-Carr.

From FIG. 6, it can be seen that threadably mounted to threaded rod portions (190) and (192), respectively, are outer skin drive nuts (194) and (196) which include outer skin support spacers (198) to which armor-plated outer skin is attached through the use of drive nut bolts (199) (only one shown in FIG. 6, but four are needed). Moreover, it can be appreciated that, when electric motor (154) is energized and the front driven sprocket (176) is rotated, being attached to front door cover half drive shaft (186), it will cause the threaded rod to rotate and the outer skin drive nuts to either separate (when the door is opened) or come together (when the door is closed). In this manner, the armor skin attached to the drive nuts and other elements of roof cover assembly (140), as set forth in more detail below, will move a pair of outer skin armor-covered doors in sliding fashion between an open and a closed position.

Further, it is seen with reference to FIGS. 6 and 7 how additional elements help support the armored outer skin as it moves between the open and closed position. More specifically, FIGS. 6 and 7 illustrate a mount drawer slide (200), such as a KV8400 slide mechanism available from McMaster-Carr. That is, the mount drawer slide is a drawer slide mechanism used for desk drawers and, in this case, is used to stabilize and guide the outer skin assembly as it opens and closes. More specifically, the mount drawer slide (200) includes an outer skin support bracket (202) which slidably mounts to the slide support bracket (204) The mount drawer slide (200) mounts adjacent end plates (206) which are fastened to support shafts (180) and (188) to which is mounted slide support bracket (204) in the manner set forth in FIGS. 4 and 6.

Figure 9:
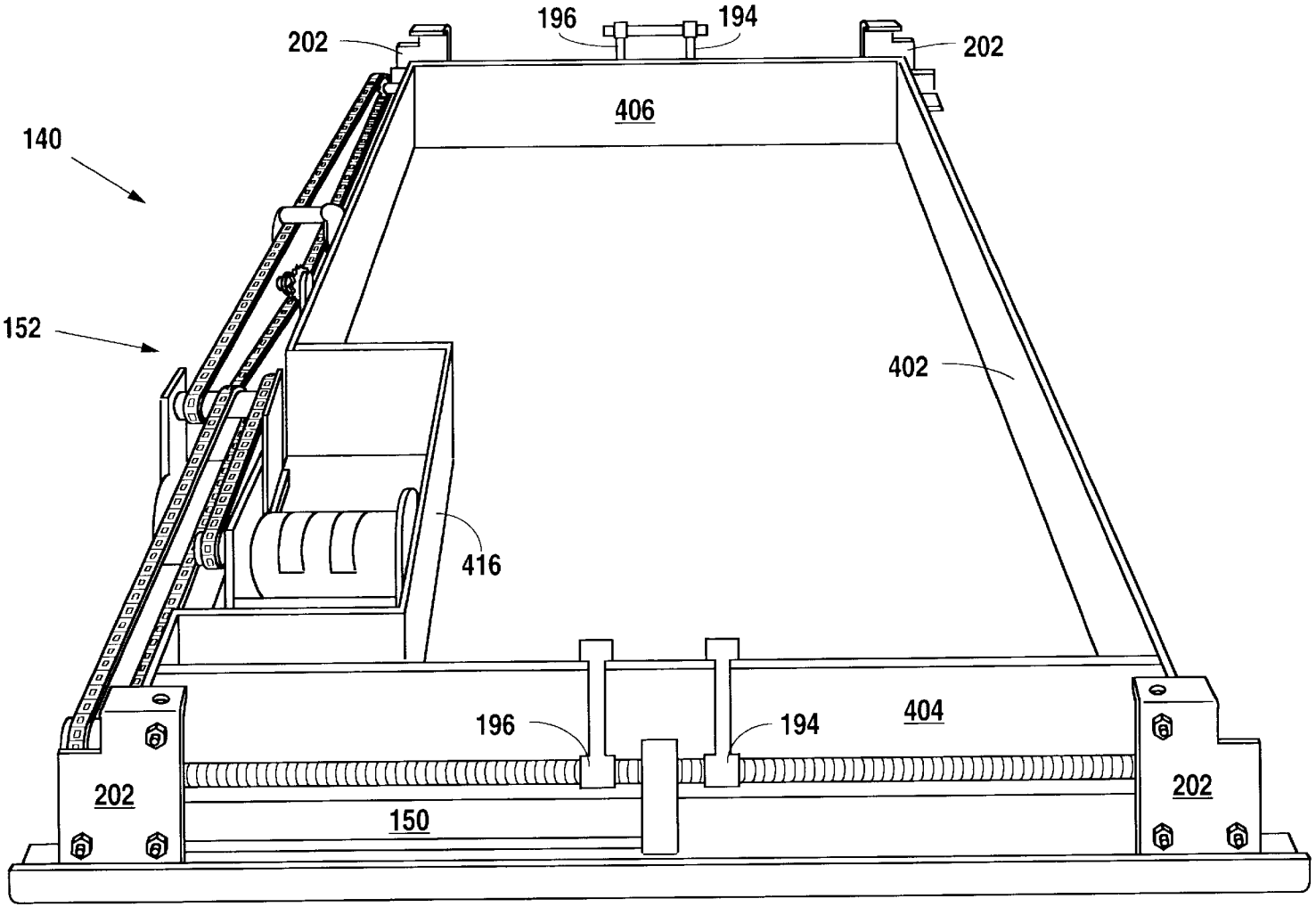
FIG. 9 is a perspective view of the roof operating assembly of Applicants' present invention including the armor skirting thereon, but with the two outer roof halves removed therefrom.

FIG. 9 illustrates armor skirting assembly (400) with roof cover drive assembly (140) and chain drive assembly (152) mounted together as a unit in preparation for receipt of outer door halves thereon.

Figure 10:
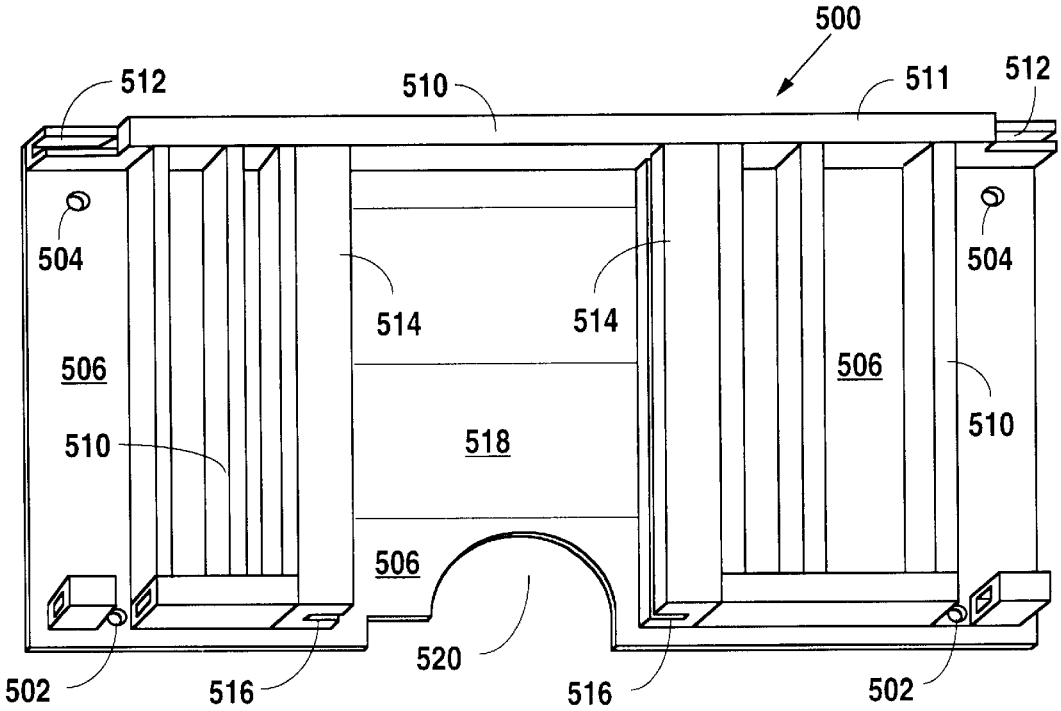
FIG. 10 is an underside perspective view of Applicants' rooftop armor cover half illustrating features thereof.

Turning now to FIG. 10, the underside of a roof top armor cover half (500) is seen. The roof top armor cover half (500) is attached through the use of drive nut bolts (199) to the drive nuts (194) and (196) of chain drive assembly (152) at drive nut holes (502). Outer skin support brackets (202) attach at outer skin support bracket holes (504). Bolt holes (502) and (504) are made through armor top plate (506) which is typically 1/8 inch ballistic steel available from Temptco of Phoenix, Ariz., as 1/8 inch BRS, also available as 1/4 inch BRS, also from Temptco. The armor plating is designed to protect the interior of the vehicle. It rides on a series of outer skin support tubes (510).

With respect to FIG. 10 it is also seen that, laying on the underside of armor top plate (506) are a pair of parallel mounted subcover guide members with tracks (516) therein in which ride armor subcover (518) which is spring loaded by spring means located in the tracks (springs not shown) towards a position covering a cutout (520) in armor top plate (506) as illustrated in FIG. 10. That is, armor subcover (518) slides in subcover guide members (514) and along tracks (516) thereof but is spring loaded in a position that will cover cutout (520) of armor top plate (506). The use of spring-loaded subcover (518) allows, when the weapon is retracted to the interior of the gun armor covering for cutout (520); but, when the weapon is in a raised position, the door halves can be closed with the cutouts (520) straddling the shaft of the Pelco™ unit.

It should be understood that only one side, in FIG. 10, of roof top cover half is illustrated, the other side being substantially similar.

Roof top armor cover half (500) (and the other half, which is not shown) may be dressed up with an attractive aluminum outer skin half (522) which would be attached to roof top armor cover half (500) by fasteners. In addition to making an attractive roof cover, aluminum skin, typically ⅛ inch polished aluminum, there is also provided, in a space between outer edge (524) of skin cover (522) and side outer skin support member (511) (see FIG. 10), a gap of typically about 2 to 4 inches for placement of video surveillance cameras (526) (one shown), as required. Each of the two roof top armor cover halves will be provided with two cameras, to give a total of four viewing cameras.

Figure 11A:
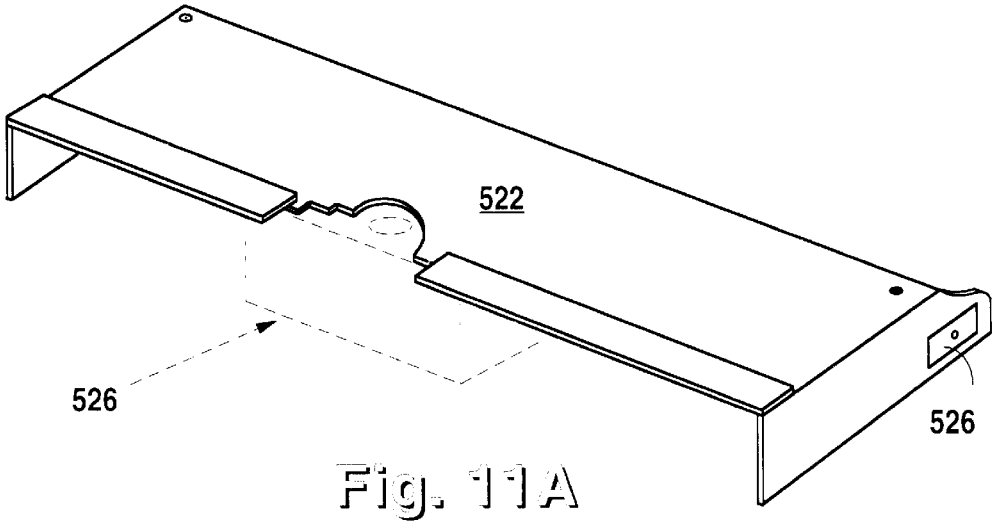
FIGS. 11A and 11B are perspective and side elevational views of the aluminum skin covering of Applicants' roof assembly illustrating the placement of video viewing cameras on the inside thereof.
Figure 11B:
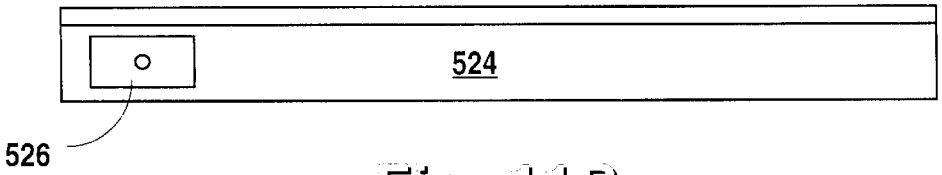

FIG. 11B illustrates, viewing from the inside, the mounting of a camera to view forward and FIG. 11A illustrates in dashed lines a second camera in the right side aluminum cover skin which is directed to the right side of the vehicle. The use of four cameras mounted 90° with respect to each other will give a full 360° view to the monitor mounted inside the vehicle in the manner set forth in more detail below. Appropriate limit switches are mounted to control the opening and closing of two door halves.

Figure 12:
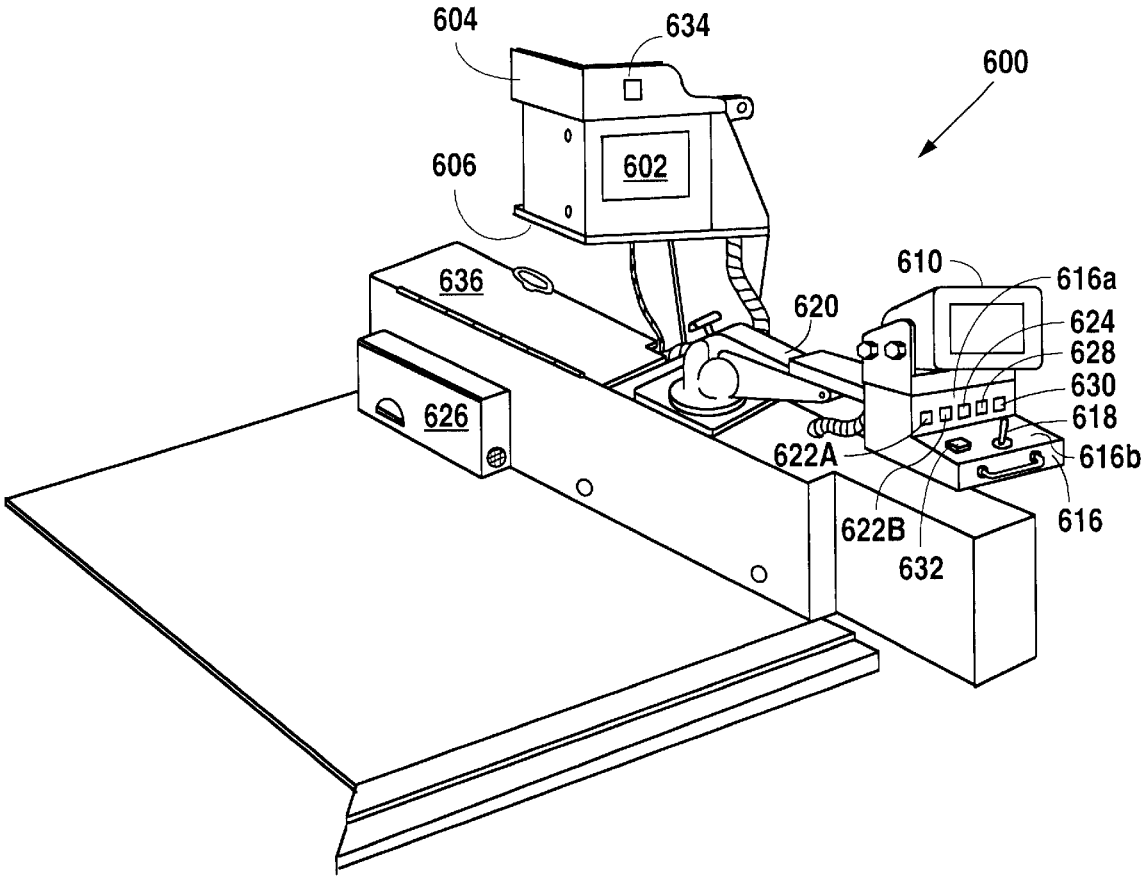
FIG. 12 is a perspective view illustrating a control center for placement in the interior of an armored vehicle for controlling Applicants' weapon system.

FIG. 12 illustrates a perspective view of the interior of a Chevrolet Suburban illustrating a control center (600). The operator of Applicant's weapon system will be seated adjacent to the control center, typically in the left rear seat, except reversed so that the operator is seated facing the rear of the vehicle. The control center (600) features a number of functions. First, the control center allows the occupant to view, through the use of the four remote viewing cameras mounted on the roof top halves (526) a panoramic 360° view of the exterior of the vehicle. Further, the control center will allow the occupant to raise and lower the weapon platform, moving the weapon from the inside of the vehicle to the outside of the vehicle and also to control the operation of the roof covers to open and close them to allow the weapon to move between the interior and the exterior of the vehicle. Further, the control center will allow the user to aim the weapon, through the use of the two pan/tilt mounted video cameras, and also to control its position with the pan/tilt unit. The details of the control is set forth below.

Video surveillance monitor (602) is provided to receive signals from the four roof-mounted video cameras and to provide a scene representing the outside of the vehicle. This monitor, along with the four cameras and the control systems, are available as a complete unit from Exxis of 1220 Champion Circle, Carrollton, Tex., as the quad observation system EO4120Q and includes a 12 inch black and white monitor with a built-in quad processor including four CCD video cameras and associated camera cables. A monitor hood (604) is provided to cover up the wiring. Monitor bracket (606) holds the monitor to the interior armor of the vehicle in a stationary position.

A sighting or aiming monitor (610) is also provided to sight or aim the weapon. Attached to the sighting monitor (610) is a pair of cables, one running to a field of view camera which mounts below the gun on camera mount bracket (123) (see FIG. 3) and an aiming camera (614) which mounts on the sight mounts of the barrel of the weapon. The cameras and monitor are available through Mobile Video Products of Dallas, Tex.

A control panel (616) is provided. The control panel (616) includes a Pelco™ joystick (618) for operating the Pelco™ pan/tilt unit. This will move the gun around to, in conjunction with the use of sighting monitor (610) and the weapon-mounted camera, aim the weapon.

The control panel (616) and the sighting monitor (610) are both mounted on an extension arm (620). Control panel (616) includes a vertical face (616*a*) and a generally horizontal face (616*b*). On the vertical face are two red push button switches (622*a*) and (622*b*) illustrated. These control the up (622*a*) and down (622*b*) motion of tower. Simultaneously, the roof door covers will open and close. That is, buttons (622*a*) and (622*b*) control the up/down power assembly motion and the roof open/closed operations.

Rocker switch (624) sends power from an interior mounted inverter (626) to the video surveillance monitor (602) so that the operator does not have to reach up and control the knobs on the monitor itself. Adjacent the switch to power the surveillance monitor (602) is a rocker switch (628) to power the Pelco™ pan/tilt unit which is energized from the inverter (626). The right-most switch on the vertical face (616*a*) is a DC power switch, typically a toggle switch, to provide DC power to the solenoid to fire the weapon and DC power to the other DC elements of the system.

At this point it is noted that on monitor head (604) is mounted an inverter on/off switch (634) which will light when the inverter is on, the inverter converting DC to AC power to power the AC elements of the control system.

Figure 13:
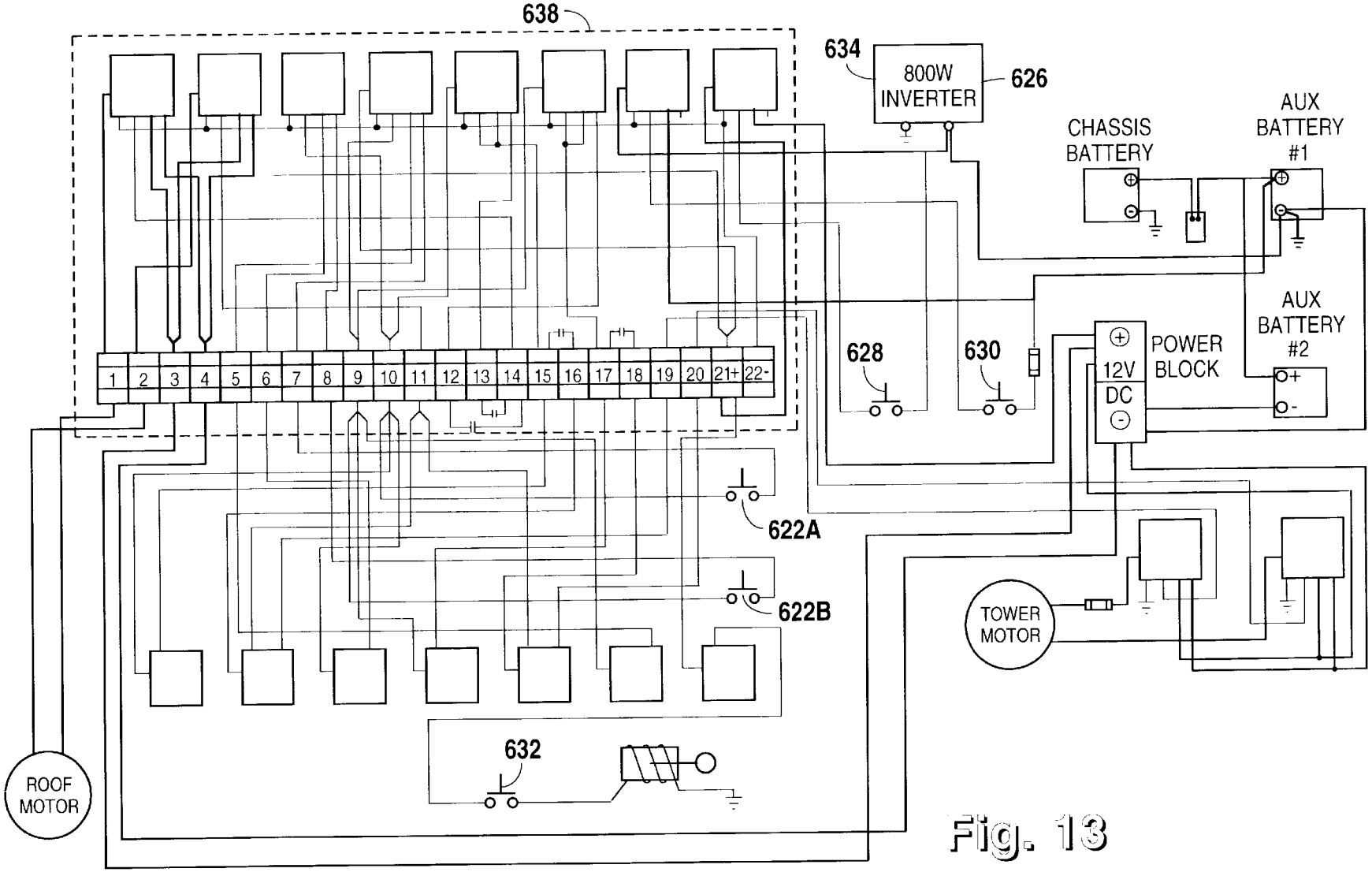
FIG. 13 illustrates electrical schematics for operating the control center and the remaining elements of Applicants' present invention.

FIG. 13 illustrates electrical schematics for operating the control center, including the video surveillance monitor (602), sighting monitor (610), the Pelco™ pan/tilt unit, and the motors which drive the platform and covers, as well as the solenoid which operates the trigger. Last, FIG. 12 illustrates compartment (636) in which implements may be stored and into which control panel as set forth in FIG. 13 below is mounted.

FIG. 13 also illustrates circuit control panel (638) which is typically mounted in compartment (636). It includes relays R1 through R10 which operate off limit switches L1 through L7 to direct DC power input to: roof motor and platform motor.

There are three power sources which come with the vehicle. These are the main charging battery which comes with the vehicle as manufactured as well as two auxiliary batteries, one mounted under the hood of the vehicle (as manufactured) and the second (provided by Applicant) mounted in compartment (636). The charging battery which comes with the vehicle is a standard heavy-duty, 12V DC found in vehicles such as the Chevrolet Suburban. Further, the first auxiliary battery mounted under the hood also comes as an option with a vehicle such as the Chevrolet Suburban or Toyota Land Cruiser. The first auxiliary mounted battery under the hood is a standard 12V charging battery. However, Applicant provides a second auxiliary battery which is a gel cell, such as a 12V gel cell provided by Optima. Use of a second auxiliary battery as a gel cell will not run the risk of generating fumes which may overcome the occupants. Applicant also provides an oscillator engaged with the standard charging battery and the first and second auxiliary batteries operated off the charging system of the vehicle to maintain a charge in the three batteries. In any case, these three batteries provide DC power to the DC motors of Applicant's invention as well as DC power to the inverter which, in turn, powers the AC elements of the system FIG. 13 also illustrates the position of the switches in the control panel in the electric circuitry that operates the power up/down, simultaneous door opening/closing (622*a*) and (622*b*), respectively, as well as the Pelco™ switch (628) and the fire button (632). The inverter is provided with a 110V plug-in to which the AC elements of the control system are engaged. The circuitry in FIG. 13 illustrates how the batteries charging the system engage the AC inverter which, in turn, will provide AC power to the AC elements of Applicant's invention.

The DC monitor for aiming the weapon described above comes with a switch (not shown) which will switch between the field of view camera mounted to the weapon mount and the aiming camera on the weapon. This way, the occupant can scan a wider field of view, select a target, and switch to the aiming camera, which provides a narrower field of view and a closer view of the target, which is mounted adjacent the gun barrel.

Figure 14:
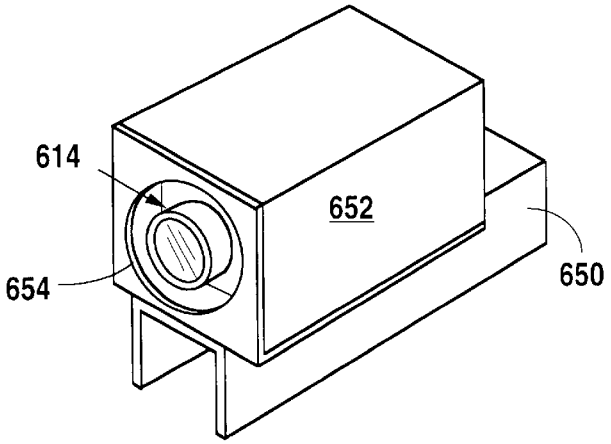
FIG. 14 is a perspective view of the bracket and camera housing for attaching to the gun sight of the weapon and for enclosing the aiming video aiming camera therein.

FIG. 14 illustrates the use of a U-shaped bracket (650) which will attach to the gun sight of the weapon provided. That is, bracket (650) has an opening at the base thereof which, through the use of suitable fasteners, will fit to the gun sight of the H&K weapon. It can be seen that attached to bracket (650) is housing (652) which is typically made of sheet metal, as is bracket (650), housing (652) for enclosing the aiming camera, with lens coming through hole (654).

Terms such as "left," "right," "up," "down," "bottom," "top," "front," "back," "in," "out," and like are applicable to the embodiments shown and described in conjunction with the drawings. These terms are merely for purposes of description and do not necessarily apply to the position or manner in which the invention may be constructed for use.

Although the invention has been described in connection with the preferred embodiment, it is not intended to limit the invention's particular form set forth, but on the contrary, it is intended to cover such alternatives, modifications, and equivalences that may be included in the spirit and scope of the invention as defined by the appended claims.

What is claimed is:

1. In a vehicle, retrofitted with armor, the vehicle having a roof with an opening therein and an interior, the interior including a floor, a weapon system, the weapon system comprising:

a frame rigidly mounted to the floor of the vehicle on the interior thereof, the frame having legs including at least one rotatable leg;

a platform for movably engaging the frame at the legs thereof;

a first motor, the first motor including means for engaging the rotatable legs of the frame to move the platform between a raised position and a lowered position;

motorized means for removably covering the opening in the roof of said vehicles and a weapon for mounting to the upper surface of the platform such that, when the platform is in a lowered position, the weapon is in the interior of the vehicle and, when the platform is in a raised position, the weapon is above the roof of the vehicle.

2. The weapon system of claim 1 further including a remote controlled, pan/tilt unit for mounting to said platform on an upper surface thereof, the pan/tilt unit including a weapon mount for carrying said weapon thereon, such that the weapon can move in two axes and such movement is capable of being controlled from the interior of the vehicle.

3. The weapon system of claim 2 further including a remote viewing means, said remote viewing means including at least one video camera for mounting to either of the weapon mount or the pan/tilt unit and further including at least one monitor for mounting to the interior of the vehicle.

4. The weapon system of claim 1 further including control means for controlling the operation of the first and second motor means from the interior of the vehicle.

5. The weapon system of claim 4 further including means for remotely firing the weapon from the interior of the vehicle when the platform is in the raised position.

6. In a vehicle retrofitted with armor, the vehicle having a roof with an opening therein and an interior, the interior including a floor, a weapon system, the weapon system comprising:

a frame rigidly mounted to the floor of the vehicle and the interior thereof, the frame with legs including at least one rotatable leg;

a platform, said platform moving and engaging the frame at the legs thereof for moving the frame between a lowered and raised position;

a first motor, the first motor including a shaft having at least one pulley mounted thereon;

a belt for engaging the pulley of the first motor and at least one rotatable leg of the frame wherein energizing the first motor causes the at least one leg to rotate and move the platform between the lowered and the raised positions;

a remote controlled pan/tilt unit, mounted to an upper surface of the platform and including a weapon mount mounted to the pan/tilt unit, the unit capable of moving the weapon mount into axes and such movement capable of being controlled from the interior of the vehicle;

a remote viewing means, said remote viewing means including at least one video camera for mounting to either of the weapon mount or the pan/tilt unit and a monitor for mounting to the interior of the vehicle;

means for removably covering the opening in the roof of said vehicle, said removable covering means including a second motor for operating said removable covering means;

control means for operating said first and said second motor from the interior of the vehicle; and a weapon for mounting to the weapon mount of said pan/tilt unit and remote firing means for remotely firing the weapon when the platform is in said raised position.

7. In a vehicle, retrofitted with armor, the vehicle having a roof with an opening therein and an interior, the interior including a floor, a weapon system, the weapon system comprising:

a frame rigidly mounted to the floor of the vehicle on the interior thereof, the frame having legs including at least one rotatable leg;

a platform for movably engaging the frame at the legs thereof;

a first motor, the first motor including means for engaging a rotatable leg of the frame to move the platform between a raised position and a lowered position wherein the first motor includes at least one pulley and at least one belt, the belt for engaging the pulley when the pulley is mounted to a drive shaft of the first motor and for engaging at least one rotatable leg of said frame; and a weapon for mounting to the upper surface of the platform such that, when the platform is in a lowered position, the weapon is in the interior of the vehicle and, when the platform is in a raised position, the weapon is above the roof of the vehicle.

8. In a vehicle, retrofitted with armor, the vehicle having a roof with an opening therein and an interior, the interior including a floor, a weapon system, the weapon system comprising:

a frame rigidly mounted to the floor of the vehicle on the interior thereof, the frame having legs including at least one rotatable leg;

a platform for movably engaging the frame at the legs thereof;

a first motor, the first motor including means for engaging the rotatable legs of the frame to move the platform between a raised position and a lowered position;

a remote controlled, pan/tilt unit for mounting to said platform on an upper surface thereof, the pan/tilt unit including a weapon mount for carrying a weapon thereon, such that the weapon can move in two axes and such movement is capable of being controlled from the interior of the commercial vehicle; and said weapon for mounting to the upper surface of the platform such that, when the platform is in a lowered position, the weapon is in the interior of the vehicle and, when the platform is in a raised position, the weapon is above the roof of the vehicle.

9. In a vehicle, retrofitted with armor, the vehicle having a roof with an opening therein and an interior, the interior including a floor, a weapon system, the weapon system comprising:

a frame rigidly mounted to the floor of the vehicle on the interior thereof, the frame having legs including at least one rotatable leg;

a platform for movably engaging the frame at the legs thereof;

a first motor, the first motor including means for engaging the rotatable legs of the frame to move the platform between a raised position and a lowered position;

a remote viewing means including at least one video camera mountable adjacent said platform;

a weapon for mounting to the upper surface of the platform such that, when the platform is in a lowered position, the weapon is in the interior of the vehicle and, when the platform is in a raised position, the weapon is above the roof of the vehicle; and means for remotely firing the weapon from the interior of the vehicle when the weapon is in the raised position.

* * * * *